US008339436B2

(12) United States Patent
Morooka

(10) Patent No.: US 8,339,436 B2
(45) Date of Patent: Dec. 25, 2012

(54) EXPOSURE UNIT CONTAINMENT MECHANISM AND IMAGE-FORMING APPARATUS

(75) Inventor: Junichi Morooka, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 151 days.

(21) Appl. No.: 12/831,635

(22) Filed: Jul. 7, 2010

(65) Prior Publication Data

US 2011/0116063 A1 May 19, 2011

(30) Foreign Application Priority Data

Nov. 19, 2009 (JP) ..... 2009-264055

(51) Int. Cl.
*B41J 2/435* (2006.01)

(52) U.S. Cl. ..... 347/263; 347/245

(58) Field of Classification Search ..... None
See application file for complete search history.

(56) References Cited

U.S. PATENT DOCUMENTS

2003/0081963 A1* 5/2003 Mogi ..... 399/118
2006/0262373 A1* 11/2006 Oda et al. ..... 359/205

FOREIGN PATENT DOCUMENTS

JP A-2003-131159 5/2003
JP A-2004-050671 2/2004
JP A-2004-258519 9/2004
JP A-2006-198886 8/2006

* cited by examiner

*Primary Examiner* — Matthew Luu
*Assistant Examiner* — Kendrick Liu
(74) *Attorney, Agent, or Firm* — Oliff & Berridge, PLC

(57) ABSTRACT

An exposure unit containment mechanism includes an exposure unit and a frame that defines a space into which the exposure unit is inserted, the exposure unit including: first protrusions protruding in left and right directions at a position spaced apart from a center of gravity of the exposure unit in a direction of insertion; and a second protrusion protruding in a downward direction, and the frame including: a guide member that contacts the first protrusions from above to limit upward movement of the first protrusions during insertion of the exposure unit; a first limiting member that limits movement of the second protrusion in left and right directions; a second limiting member that contacts the first protrusions from underneath to limit downward movement of the same; and a first pressing member that presses the first protrusions from above when the first protrusions are in contact with the second limiting member.

8 Claims, 7 Drawing Sheets

EXPOSURE UNIT CONTAINMENT MECHANISM AND IMAGE-FORMING APPARATUS

CROSS-REFERENCE TO RELATED APPLICATIONS

This application is based on and claims priority under 35 U.S.C. 119 from Japanese Patent Application No. 2009-264055, which was filed on Nov. 19, 2009.

BACKGROUND

1. Technical Field

The present invention relates to an exposure unit containment mechanism and an image-forming apparatus.

2. Related Art

An image-forming apparatus, such as a printer or a copy machine, is equipped with an exposure unit for performing image exposure in accordance with image data to form a latent image on a surface of a photosensitive member or the like. The exposure unit includes a light source unit having a light source and a drive circuit, a pre-deflector optical system, a light deflector (polygon lens), a scanning lens, a bending mirror, etc.

SUMMARY

In one aspect of the present invention, there is provided an exposure unit containment mechanism including: an exposure unit that performs exposure in accordance with image data; and a frame that defines a space having an opening and containing the exposure unit inserted therein through the opening, wherein the exposure unit includes: first protrusions provided at a position spaced apart from a center of gravity of the exposure unit in a direction of insertion of the exposure unit into the space, such that the first protrusions protrude left and right with respect to the direction of insertion; a second protrusion that protrudes in a direction having a downward component; and third protrusions provided at a position spaced apart from the first protrusions and the second protrusion in a direction opposite to the direction of insertion, such that the third protrusions protrude in the left and right directions, and the frame includes: a guide member that contacts the first protrusions from above to limit movement of the first protrusions in an upward direction and guide the insertion of the exposure unit; a first limiting member that, when the exposure unit is guided by the guide member into the space, contacts the second protrusion from the left and from the right to limit left and right movement of the second protrusion; a second limiting member that, in a state where the movement of the second protrusion is limited by the first limiting member, contacts the first protrusions from underneath to limit downward movement of the first protrusions; a first pressing member that presses the first protrusions from above when the first protrusions are in contact with the second limiting member; a supporting member that supports the third protrusions from underneath; a third limiting member that, in a state where the first protrusions are pressed by the first pressing member, contacts the third protrusions in the direction opposite to the direction of insertion to limit movement of the third protrusions in the direction of insertion; and a second pressing member that presses the third protrusions, whose movement in the direction of insertion is limited by the third limiting member, against the third limiting member and against the supporting member.

BRIEF DESCRIPTION OF THE DRAWINGS

Exemplary embodiments of the present invention will now be described in detail with reference to the following figures, wherein.

DETAILED DESCRIPTION

<1. Exemplary Embodiment>

Figure 1:
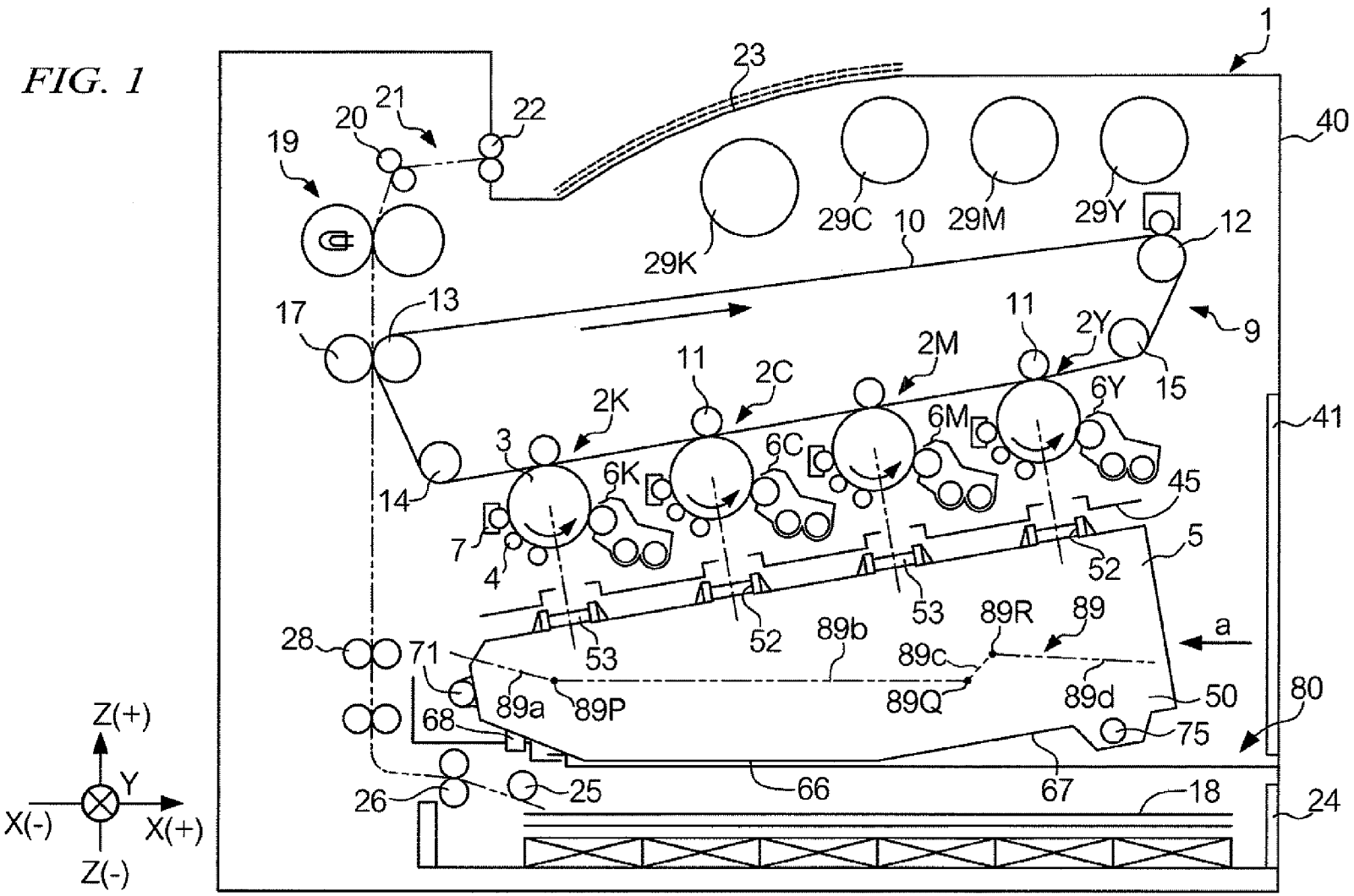
FIG. 1 is a schematic view showing a configuration of an image-forming apparatus according to an exemplary embodiment of the present invention.

An image-forming apparatus, such as a printer or a copy machine, is provided with a cover on a side of a housing, for example, in such a manner that the cover can be opened and closed to facilitate maintenance or replacement of a component part, or removal of a jammed sheet. In the following, taking such an image-forming apparatus as an example, explanation will be made of an exemplary embodiment of the present invention. FIG. 1 schematically shows a configuration inside a main body of image-forming apparatus 1.

In the following description, as indicated in the drawings, when the image-forming apparatus is viewed from its front by a user, the horizontal direction is denoted as the X-axis direction, with right/left directions from the user's perspective being indicated by X(+) and X(−), respectively; the front-back direction of the image-forming apparatus is denoted as the Y-axis direction, with back/front directions of the image-forming apparatus being indicated by Y(+) and Y(−), respectively; and the vertical direction is denoted as the Z-axis direction, with up/down directions being indicated by Z(+) and Z(−), respectively.

<Configuration of Image-Forming Apparatus>

First, explanation will be made of an example of an internal configuration and operation of image-forming apparatus 1. Image-forming apparatus 1 is adapted to constitute a full-color printer, and contains an image-processing unit (not shown in the drawings) that performs image-processing on image data received from a device such as a scanner or a personal computer (not shown in the drawings), or received via a telephone line (not shown in the drawings), etc. Provided inside image-forming apparatus 1 are four image-forming units 2Y, 2M, 2C, 2K for yellow (Y), magenta (M), cyan (C), and black (K), respectively. Image-forming units 2Y, 2M, 2C, 2K are arranged generally in the horizontal direction so as to be spaced apart from each other and to extend in parallel, and vertical positions of image-forming units 2Y, 2M, 2C, 2K are respectively lower in this order (thus, the vertical position of image-forming unit 2Y is higher than that of image-forming unit 2K), whereby a plane in which image-forming units 2Y, 2M, 2C, 2K are arranged is inclined at a certain angle (e.g., 10 degrees) with respect to the horizontal direction. By this arrangement of image-forming units 2Y, 2M, 2C, 2K in a plane inclined with respect to the horizontal direction, the horizontal dimension is reduced in comparison with a case where image-forming units 2Y, 2M, 2C, 2K are arranged in a horizontal plane.

Each of the four image-forming units 2Y, 2M, 2C, 2K has basically the same structure, and contains photosensitive drum 3 that is driven to rotate at a certain speed and that serves as an image-holding member, primary charging roll 4 that charges a surface of photosensitive drum 3, developer unit 6 that develops, with toner, an electrostatic latent image formed on photosensitive drum 3 as a result of image exposure performed by image exposure unit 5 (described later), and cleaning unit 7 that cleans the surface of photosensitive drum 3. Photosensitive drum 3 is constituted, for example, of an organic photosensitive member having a cylindrical shape with a diameter of 30 mm, and having an overcoat layer on its surface. Photosensitive drum 3 is rotated by a drive motor (not shown in the drawings), which serves as a drive unit. Charging roll 4 is, for example, a roll-shaped charger constituted of a core bar coated with a conductive layer made of a synthetic resin or rubber and having an adjusted electric resistance, and a charging bias is applied to the core bar of charging roll 4. Further, a cleaning roll for removing foreign matters such as toner adhering to a surface of charging unit 4 is arranged to contact the surface of charging roll 4.

In the following description, where it is not necessary to distinguish between image-forming units 2Y, 2M, 2C, 2K, the image-forming units will be simply referred to as image-forming unit(s) 2.

Below image-forming units 2 is provided image exposure unit 5, which is an example of an exposure unit that performs exposure in accordance with image data. Image exposure unit 5 has four semiconductor laser units (not shown in the drawings) for emitting laser beams modulated in accordance with the image data. The four laser beams emitted from these semiconductor laser units are deflected by a polygon mirror for scanning, and are irradiated onto photosensitive drum 3 of each image-forming unit 2 via optical elements such as a lens and a mirror (not shown in the drawings). Image exposure unit 5 extends along an underside of the four image-forming units 2, which, as mentioned in the foregoing, are arranged in a plane inclined with respect to the horizontal direction. Thus, a length of a light path of the laser beam irradiated onto photosensitive drum 3 is the same for each of image-forming units 2Y, 2M, 2C, and 2K.

Image exposure unit 5, which is provided in common to each image-forming unit 2, receives image data of respective colors sequentially from the image-processing unit. The laser beam emitted from image exposure unit 5 in accordance with the image data is irradiated onto a surface of corresponding photosensitive drum 3 to form an electrostatic latent image thereon. The electrostatic latent images formed on photosensitive drums 3 for respective colors are developed by developer units 6Y, 6M, 6C, 6K to form toner images of respective colors. The toner images of respective colors formed sequentially on photosensitive drums 3 of image-forming units 2 are transferred one on top of another by primary transfer rolls 11 to intermediate transfer belt 10, which is arranged obliquely over the top of each image-forming unit 2, and serves as an intermediate transfer member.

Intermediate transfer belt 10 is an endless belt-shaped member tension-supported by multiple rolls. Specifically, intermediate transfer belt 10 is wound around drive roll 12, backup roll 13, tension roll 14, and idler roll 15, such that intermediate transfer belt 10 is circulatingly moved in a direction indicated by an arrow in FIG. 1 by drive roll 12, which is rotated by a dedicated drive motor (not shown in the drawings) capable of maintaining a constant rotation speed. Intermediate transfer belt 10 has an upper moving section and a lower moving section, and the lower moving section is inclined with respect to the horizontal direction, with a downstream end of the lower moving section positioned lower than an upstream end of the same with respect to the direction of movement of the lower moving section. As intermediate transfer belt 10, a flexible film made of a synthetic resin, such as polyimide, may be used, where the ends of the synthetic resin film are connected by means of welding or the like to form an endless belt member. Intermediate transfer belt 10 is arranged such that the lower moving section is in contact with photosensitive drums 3Y, 3M, 3C, 3K of image-forming units 2Y, 2M, 2C, 2K.

It is to be noted that intermediate transfer belt 10, primary transfer rolls 11, drive roll 12, backup roll 13, tension roll 14, idler roll 15, etc., are integrated into a single unit referred to as intermediate transfer unit 9.

At a position opposed to backup roll 13 across intermediate transfer belt 10 is provided secondary transfer roll 17, which is urged against intermediate transfer belt 10. Secondary transfer roll 17 functions to cause the toner images, which have been primary-transferred onto intermediate transfer belt 10, to be secondary-transferred onto recording sheet 18, which serves as a recording medium. Specifically, when recording sheet 18 moves between secondary transfer roll 17 and intermediate transfer belt 10, secondary transfer roll 17 presses recording sheet 18 against intermediate transfer belt 10, whereby the toner images of yellow (Y), magenta (M), cyan (C), and black (K), which have been overlappingly transferred onto intermediate transfer belt 10, are transferred onto recording sheet 18 owing to pressure and electrostatic force. Recording sheet 18 on which the toner images of respective colors have been transferred is conveyed upward to fixing unit 19. Fixing unit 19 applies a heat and pressure to recording sheet 18 to fix the toner images of respective colors onto recording sheet 18. Thereafter, recording sheet 18 passes through exit roll 20 of fixing unit 19, and is conveyed through sheet-discharging path 21 to discharge roll 22, from which recording sheet 18 is discharged onto sheet-receiving tray 23 provided at an upper portion of image-forming apparatus 1. Image-forming units 2, intermediate transfer unit 9, secondary transfer roll 17, and fixing unit 19 constitute an example of an image-forming device that develops a latent image in accordance with exposure performed by an exposure unit contained in a space defined inside image-forming apparatus 1, transfers the developed image onto a medium, and fixes the transferred image.

Recording sheets 18, having a prescribed size and being made of a prescribed material, are contained in sheet container 24 disposed inside image-forming apparatus 1, and are conveyed, one sheet at a time, from sheet container 24 to registration roll 28 by means of sheet supply roll 25 and a pair of rolls 26 for sheet separation and conveyance. From there, recording sheet 18 is further conveyed to the secondary transfer position defined between intermediate transfer belt 10 and secondary transfer roll 17 by registration roll 28, which is rotated at a predetermined timing.

Arranged between sheet-receiving tray 23 and intermediate transfer belt 10 are toner cartridges 29Y, 29M, 29C, 29K serving as toner containers. Toner cartridges 29Y, 29M, 29C, and 29K supply toner to developer units 6Y, 6M, 6C, and 6K, respectively. Toner cartridge 29K containing toner of black (K) is larger than the toner cartridges of the other colors because black toner is used more frequently than toner of the other colors.

Each component part constituting image-forming apparatus 1 is contained in box-shaped main body 40 of image-forming apparatus 1. In main body 40, upper partition plate 45 is provided above image exposure unit 5 (on Z(+) side of image exposure unit 5) and supporting plate 80 is provided below exposure unit 5 (on Z(−) side of image exposure unit 5) for containment of image exposure unit 5, and upper partition plate 45 and supporting plate 80 are secured to main body (or frame) 40 by means of welding or the like. Upper partition plate 45 and supporting plate 80 define a space between them, into which image exposure unit 5 is inserted. On a right side of main body 40 in FIG. 1 (i.e., on a side facing in the X(+) direction), side cover 41 is detachably attached. When side cover 41 is opened, image exposure unit 5 can be installed or removed through an opening that connects the space to an outside. Specifically, image exposure unit 5 is inserted into image-forming apparatus 1 through the opening of main body 40 in a direction indicated by arrow "a" (in the X(−) direction), and is moved in a direction opposite to the direction indicated by arrow "a" (in the X(+) direction) to be removed from main body 40. Thus, main body 40 serves as an example of a frame that defines a space having an opening and containing the exposure unit inserted therein through the opening.

As shown by a long- and double-short dashed line in FIG. 1, a pair of guides 89 each formed of a metallic plate or the like is securely attached by means of welding or the like to front and back portions of main body 40 respectively located on Y(−) and Y(+) sides of the space into which image exposure unit 5 is inserted. Each guide 89 has guide surfaces 89*a*, 89*b*, 89*c*, and 89*d*, which adjoin each other via bending lines 89P, 89Q, and 89R each extending in the Y-axis direction. When image exposure unit 5 is inserted into the space, each of the pair of guides 89 is spaced apart from casing 50 of image exposure unit 5 in Y(+) and Y(−) directions, respectively. Also, a position of each guide 89 in the Z-axis direction is determined such that guide 89 is placed lower than (or placed on the Z(−) side of) any part of upper partition plate 45.

<Outer Shape of Image Exposure Unit>

Figure 2A:
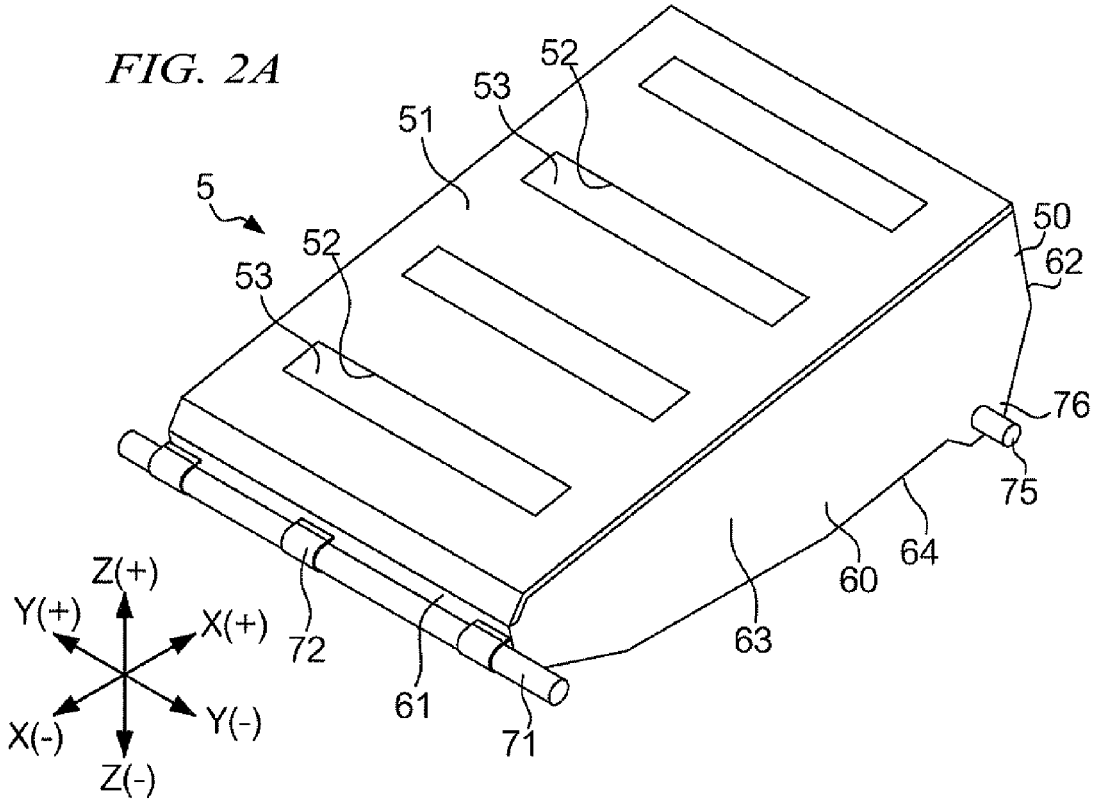
FIGS. 2A and 2B show an outer shape of an image exposure unit.
Figure 2B:
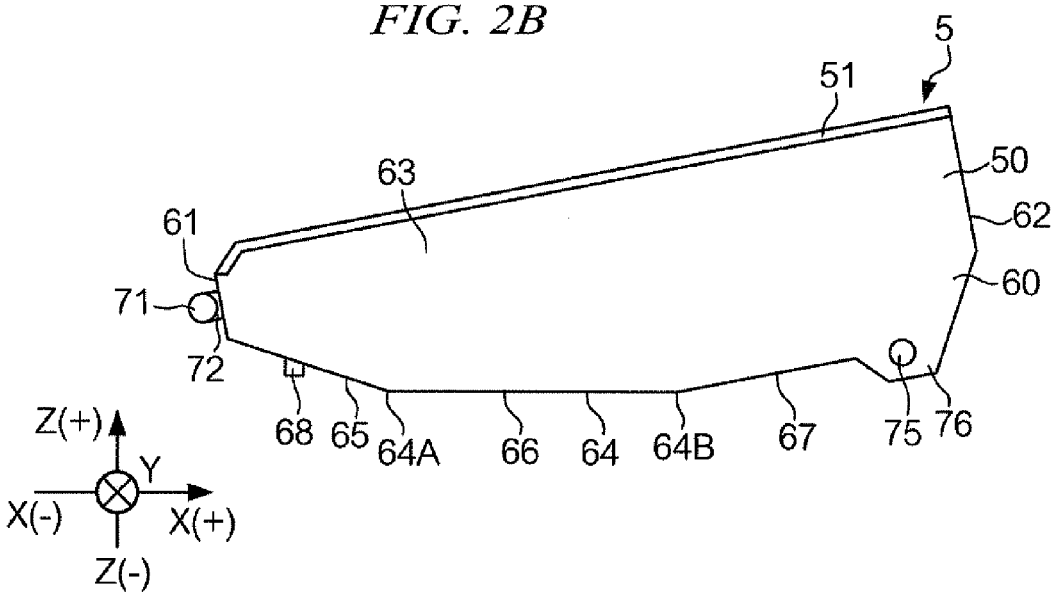

With reference to FIGS. 2A and 2B, explanation will now be made of casing 50, which defines an outer shape of image exposure unit 5. Casing 50 is made of a resin material, and as shown in FIGS. 2A and 2B, includes lid 51 having four rectangular light-transmitting portions 52, which are spaced apart from each other in the X-axis direction and extend in the Y-axis direction, and box body 60 having an opening that can be closed by lid 51. Each light-transmitting portion 52 includes transparent member 53 made of glass, plastic, or the like, fitted therein.

Box body 60 has leading end portion 61 on the X(−) side, trailing end portion 62 on the X(+) side, a pair of side portions 63 on the Y(−) and Y(+) sides, and bottom portion 64 on the Z(−) side. Trailing end portion 62 has a greater height than leading end portion 61, and side portions 63 each have a generally trapezoidal shape.

Bottom portion 64 has three surfaces, which adjoin each other via bending lines 64A and 64B each extending in the Y-axis direction. The three surfaces include insertion surface 65, guide surface 66, and spaced surface 67, which are arranged in this order from the leading end side (or from the X(−) side). Guide surface 66 serves as a reference surface during the insertion. Formed at a central portion of insertion surface 65 in the Y-axis direction is positioning protrusion 68, which projects in a direction having a component along the Z(−) direction (or a direction having a downward component with respect to the direction of gravity). Thus, positioning protrusion 68 is an example of a second protrusion that is provided to an exposure unit to protrude in a direction having a downward component. It is also to be noted that movement of the second protrusion is limited by a limiting member (described later), and thus, the second protrusion is an example of a lower-part engagement member. Insertion surface 65, which adjoins guide surface 66 via bending line 64A, is inclined upward at a certain angle relative to guide surface 66, so that in a state where image exposure unit 5 is arranged horizontally, with guide surface 66 of bottom portion 64 being placed on a horizontal portion (second plate member 90 (described later)) of supporting plate 80, an end of positioning protrusion 68 does not contact the horizontal portion of supporting plate 80.

Also, in this state, an angle of inclination of lid 51 relative to the X-axis is the same as an angle of inclination of the plane in which image-forming units 2Y, 2M, 2C, and 2K are arranged, which is 10 degrees, for example. Owing to such a configuration, lengths of light paths of the laser beams irradiated from image exposure unit 5 onto respective photosensitive drums 3 of image-forming units 2Y, 2M, 2C, and 2K are the same. Of the optical elements such as a semiconductor laser, polygon mirror, lens, mirror, etc., the polygon mirror, which is relatively heavy, and a drive motor therefor are disposed near trailing end portion 62, while most of the other optical elements are disposed along inclined lid 51. Further, to reduce a volume of image exposure unit 5, spaced surface 67, which adjoins guide surface 66 via bending line 64B, is inclined upward relative to guide surface 66.

On leading end portion 61, first supporting pin 71 is supported by means of three pin-supporting members 72, whereby first supporting pin 71 projects in the X(−) direction. It is to be noted, however, that first supporting pin 71 does not have to project in the X(−) direction, so long as the position of first supporting pin 71 in the X-axis direction is spaced apart from the center of gravity of image exposure unit 5 in the direction of insertion. Longitudinal ends of first supporting pin 71 protrude from side portions 63 in the Y(−) and Y(+) directions or in left and right directions with respect to the direction of insertion of image exposure unit 5 into image-forming apparatus 1. Thus, first supporting pin 71 is an example of first protrusions provided at a position spaced apart from a center of gravity of the exposure unit in a direction of insertion of the exposure unit into the space defined by the frame of the image-forming apparatus, where the first protrusions protrude in left and right directions with respect to the direction of insertion. Also, first supporting pin 71 is held by a first holding member (described later) when image exposure unit 5 is contained in the space defined in main body 40 of image-forming apparatus 1, and thus, serves as an example of a first engagement member provided at a position spaced apart from the center of gravity of the exposure unit in the direction of insertion.

In a part of bottom portion 64 near trailing end portion 62, second supporting pins 75 are provided via pin-supporting tongue members 76, such that second supporting pins 75 protrude from side portions 63 in the Y(−) and Y(+) directions (or in left and right directions with respect to the direction of insertion of image exposure unit 5 into image-forming apparatus 1). It is to be noted here that the position of second supporting pin 75 in the X-axis direction is spaced apart from each of first supporting pin 71 and positioning protrusion 68 in a direction opposite to the direction of insertion of image exposure unit 5 into image-forming apparatus 1. Thus, second supporting pins 75 serve as an example of third protrusions provided to the exposure unit at a position spaced apart from the first protrusions and the second protrusion in a direction opposite to the direction of insertion of the exposure unit into the image-forming apparatus, where the third protrusions protrude in the left and right directions with respect to the direction of insertion.

During the insertion of image exposure unit 5, end portions of first supporting pin 71, which protrude in the longitudinal direction of supporting pin 71, are in contact with an underside (Z(−) side) surface of respective guides 89 while being moved in the X(−) direction. Therefore, casing 50 of image exposure unit 5 is inserted into image-forming apparatus 1, with first supporting pin 71 being pressed downward (in the Z(−) direction) by guides 89 such that first supporting pin 71 does not move upward (in the Z(+) direction) beyond the underside surface of guides 89. As stated in the foregoing, because relatively heavy optical elements are disposed near trailing end portion 62 of image exposure unit 5, leading end portion 61 of image exposure unit 5 tends to be lifted, with bending line 64B being a fulcrum, for example. However, as is described in the foregoing, first supporting pin 71 is pressed by guides 89 so as not to move upward (in the Z(+) direction), and therefore, image exposure unit 5 can be inserted into image-forming apparatus 1 without lid 51 contacting upper partition plate 45. Thus, guides 89 provided to main body 40 serve as an example of a guide member that contacts the first protrusions from above to limit upward movement of the first protrusions and guide the insertion of the exposure unit.

<Shape of Supporting Plate>

Figure 3:
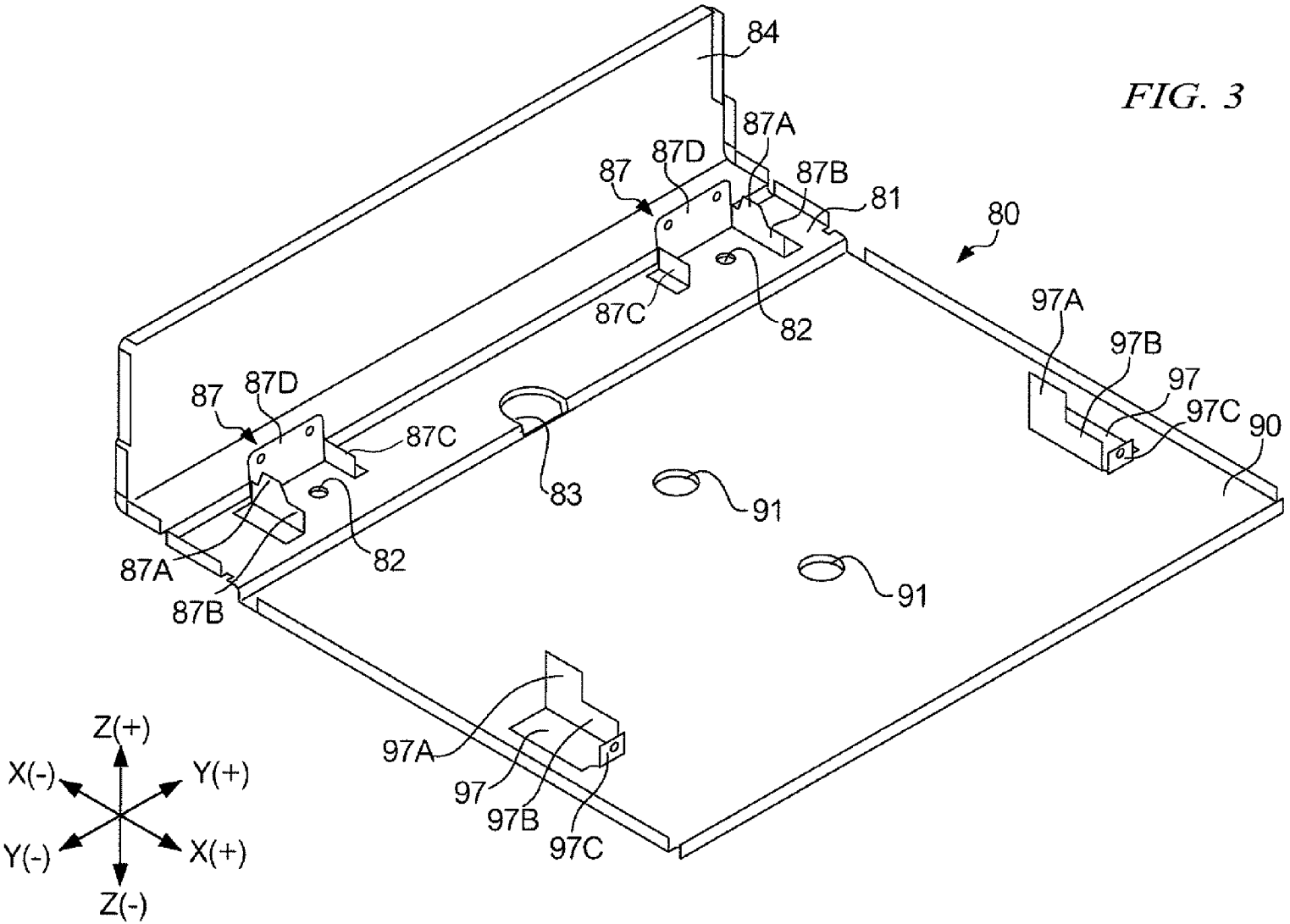
FIG. 3 is a perspective view showing a supporting plate.

Next, with reference to FIG. 3, explanation will be made of supporting plate 80 for securely holding image exposure unit 5 to main body 40.

Supporting plate 80 includes first plate member 81 and second plate member 90, and Y(−) and Y(+) ends of each of first and second plate members 81 and 90 are fixed to main body 40 by means of laser welding or the like. As described in the foregoing, image-forming units 2 and intermediate transfer unit 9 are arranged to be inclined with respect to the horizontal direction, and lid 51 of image exposure unit 5 installed in main body 40 for irradiating laser beams onto image-forming units 2 is also inclined in accordance with the inclination of arrangement of image-forming units 2. First plate member 81 is an example of a supporting plate that supports the exposure unit from underneath when the exposure unit is contained in the image-forming apparatus.

First plate member 81 is located at a position distant from cover 41 in the direction of insertion (X(−) direction). First plate member 81 has two jig holes 82 formed at positions spaced apart from each other in the Y-axis direction, U-shaped insertion groove 83 that opens in the direction opposite to the direction of insertion (in the X(+) direction) to receive positioning protrusion 68 therein, and planar upright portion 84 extending in the Z(+) direction at a position spaced apart from jig holes 82 in the direction of insertion (X(−) direction). First plate member 81 has step portions formed by bending first plate member 81 along bending lines extending in the Y-axis direction, whereby first plate member 81 includes a horizontal portion positioned higher than a horizontal surface of second plate member 90, and insertion groove 83 is formed in the horizontal portion of first plate member 81 such that insertion groove 83 opens in the direction opposite to the direction of insertion at a step portion close to second plate member 90. Second plate member 90 is located at a position near cover 41, and is a plate member having two jig holes 91 spaced apart in the X-axis direction. End portions of first and second plate members 81, 90 are bent to form ribs to increase the strength of first and second plate members 81, 90.

Figure 4:
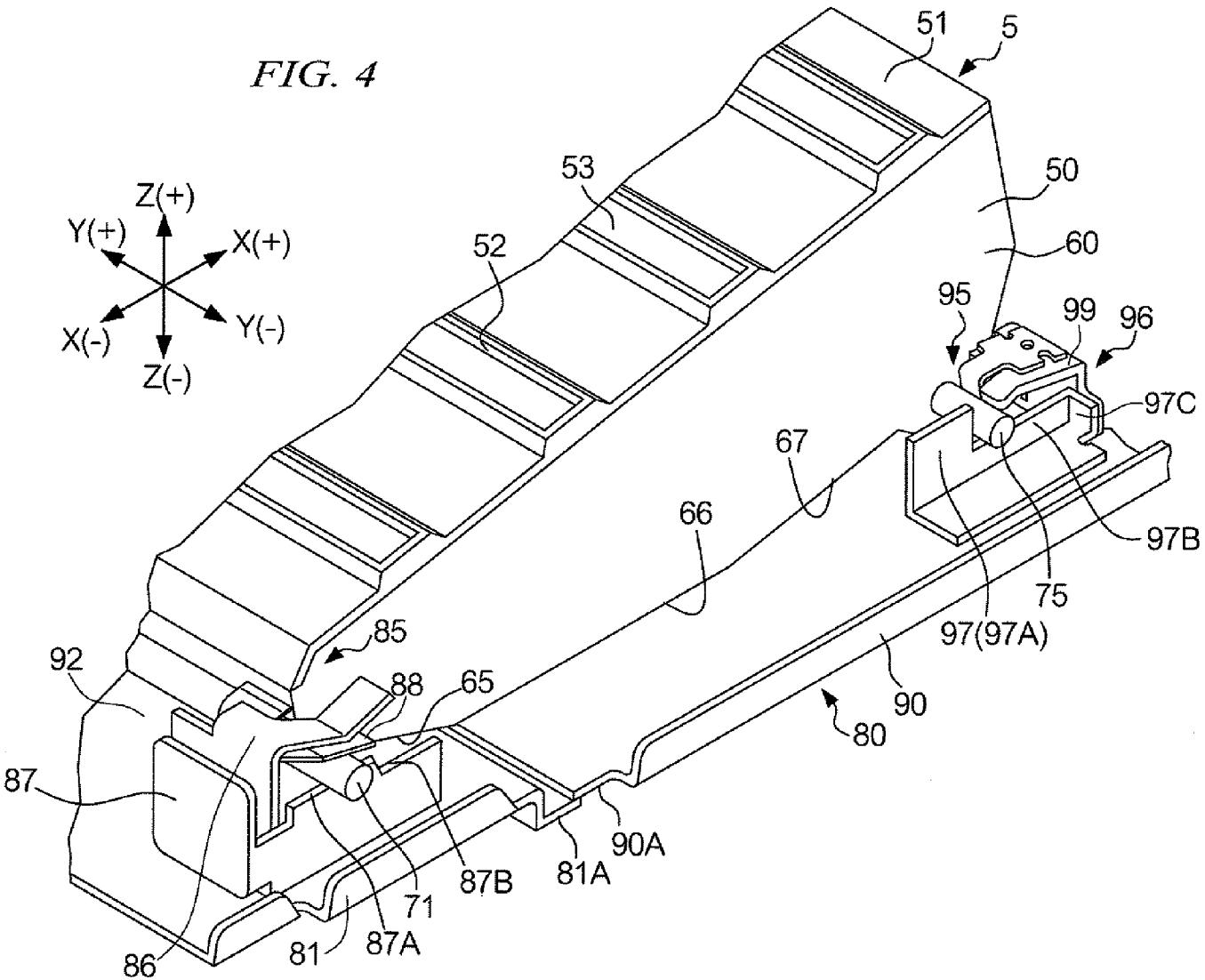
FIG. 4 shows an essential part of the image exposure unit attached to the supporting plate.
Figure 6A:
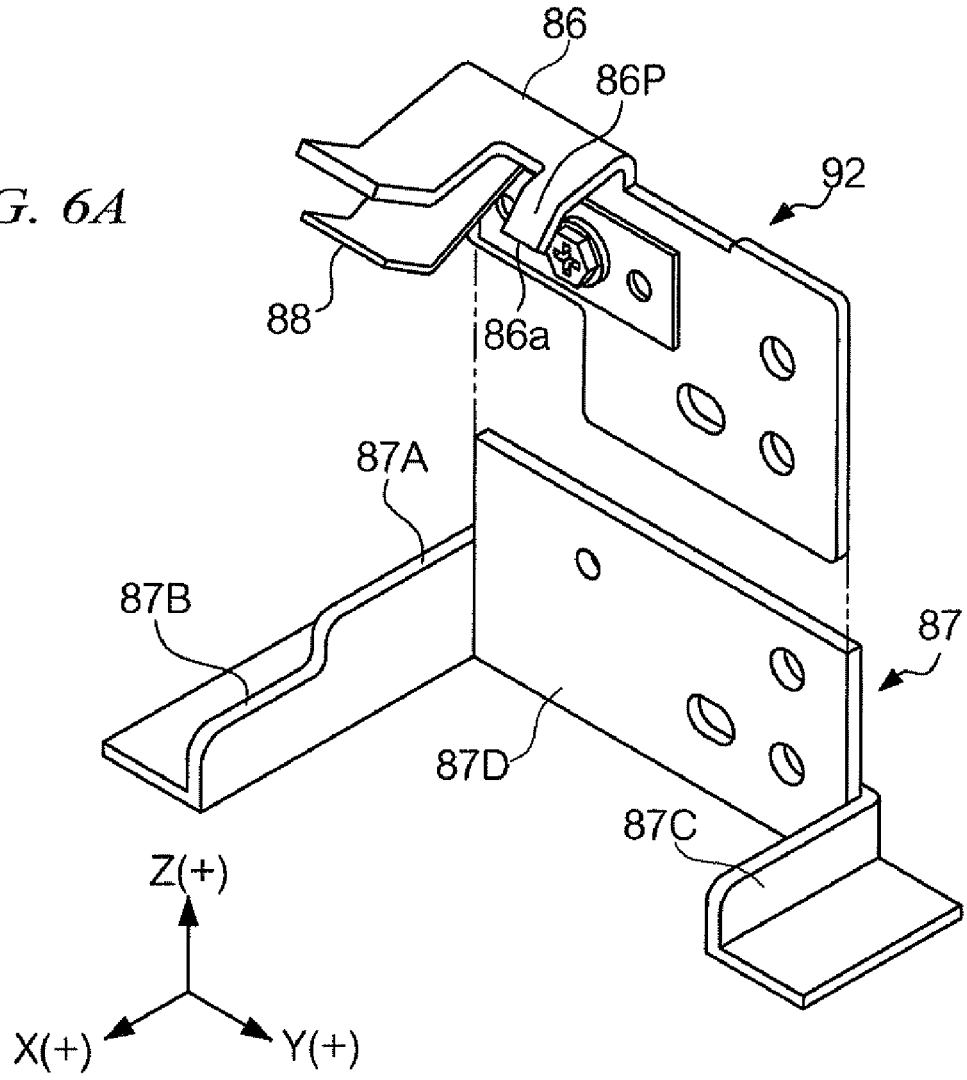
FIGS. 6A and 6B show details of a first bracket.
Figure 6B:
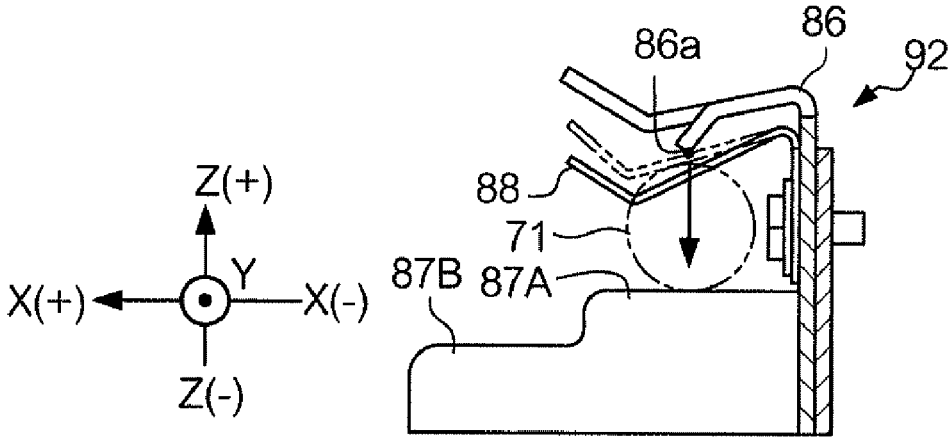

Fixed to first plate member 81 at two positions spaced apart from each other in the Y-axis direction are a pair of first supporting pieces 87, to each of which flat spring 88 is attached via spring mount 86 to form first bracket 92, as shown in FIGS. 4 and 6, for holding a corresponding end of first supporting pin 71. A plate member that is bent to have first to fourth upright portions 87A, 87B, 87C, and 87D forms each first supporting piece 87. First and second upright portions 87A and 87B adjoin each other and extend along the X-axis, and second upright portion 87B, which is positioned closer to cover 41 of main body 40 than first upright portion 87A, has a lower height than first upright portion 87A. First and second upright portions 87A and 87B are adapted to contact first supporting pin 71 from underneath to support the same. Third upright portion 87C, which is opposed to first upright portion 87A in the Y-axis direction, is provided for fixing first supporting piece 87 to supporting plate 80, and is secured to supporting plate 80 by means of welding, riveting, or the like. Fourth upright portion 87D, which connects first and third upright portions 87A, 87C, has a supporting surface facing in the X(+) direction, to which spring mount 86 holding flat spring 88 thereon is secured by means of a bolt, for example (see FIGS. 6A and 6B). First supporting pin 71 and first brackets 92 constitute first holding mechanism 85. Also, first supporting piece 87 and flat spring 88 of each first bracket 92, which is fixedly provided to main body 40 via supporting plate 80, constitute an example of a first holding member that, in a state where the movement of the lower-part engagement member is limited by the limiting member, contacts the first engagement member (first supporting pin 71) of the exposure unit to hold the first engagement member.

On the other hand, fixed to a part of second plate member 90 near cover 41 at two positions spaced apart from each other in the Y-axis direction are a pair of second supporting pieces 97, to each of which flat spring 98 is attached via spring mount 99 to form second bracket 96, as shown in FIGS. 4 and 7, for holding corresponding second supporting pin 75. A plate member that is bent to have first to third upright portions 97A, 97B, and 97C forms each second supporting piece 97. First and second upright portions 97A and 97B adjoin each other and extend along the X-axis, and second upright portion 97B, which is positioned closer to cover 41 of main body 40 than first upright portion 97A, has a lower height than first upright portion 97A. Second upright portion 97B is adapted to contact second supporting pin 75 from underside to support the same. Third upright portion 97C has a supporting surface facing in the X(+) direction, to which spring mount 99 holding flat spring 98 thereon is attached by means of a bolt, for example, after second supporting pin 75 is positioned on top of second upright portion 97B and abuts a side edge part of first upright portion 97A, as described later. Second supporting pins 75 and second brackets 96 constitute second holding mechanism 95. Also, second supporting piece 97 and flat spring 98 of second bracket 96, which is fixedly provided to main body 40 via supporting plate 80, constitute an example of a second holding member that, in a state where the first engagement member is held by the first holding member, contacts the second engagement member (second supporting pin 75) to hold the second engagement member.

<Holding of Image Exposure Unit by Supporting Plate>

Next, with reference to FIGS. 4-7, explanation will be made of a mode of holding of image exposure unit 5 by supporting plate 80.

As indicated by arrow "a" in FIG. 1, image exposure unit 5 is inserted into main body 40 in the X(−) direction through the opening provided on the X(+) side of main body 40, with leading end portion 61 being inserted first, when cover 41 is open.

Image exposure unit 5 is moved in the direction of insertion (in the X(−) direction), with guide surface 66 being in contact with a surface of second plate member 90, and positioning protrusion 68 is inserted into insertion groove 83 to determine a position of image exposure unit in the Y-axis direction.

Figure 5:
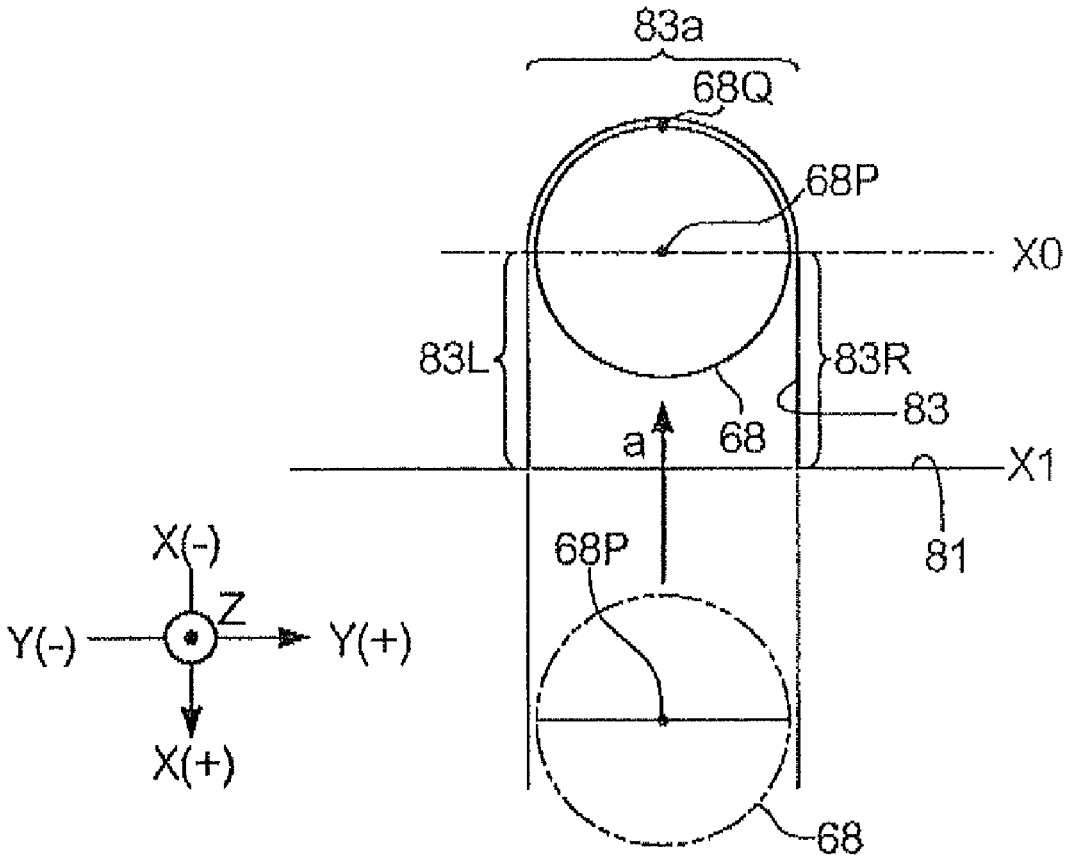
FIG. 5 shows a positioning protrusion received in an insertion groove.

FIG. 5 is a diagram showing a state where positioning protrusion 68 is inserted into insertion groove 83. FIG. 5 shows insertion groove 83 as viewed from above (in the Z(−) direction), and a cross-section of positioning protrusion 68 is circular, though it may be another shape, such as elliptic. Point 68P in the cross-section of positioning protrusion 68 is a point on a line extending in the Y-axis direction, along which positioning pin 68 has a maximum dimension in the Y-axis direction. In the embodiment shown, point 68P is a center of the cross-section of positioning pin 68. An X-axis coordinate of an X(+)-side edge of first plate member 81 (or an X-axis coordinate of an entrance of U-shaped insertion groove 83) is X1, as shown in FIG. 5. Further, an X-axis coordinate of point 68P when positioning pin 68 is inserted into insertion groove 83 to the limit in the direction of insertion (in the X(−) direction) is X0. Insertion groove 83 has straight edges 83L and 83R on left and right sides, respectively, with respect to the direction of insertion (or on Y(−) and Y(+) sides), and curved edge 83*a* defining an end distant from cover 41 in the direction of insertion (or an end on X(−)-side).

In the insertion of image exposure unit 5 into image-forming apparatus 1, when positioning protrusion 68 is moved in the direction indicated by arrow "a" in FIG. 5 (or in the X(−) direction) so that point 68P passes the X-axis coordinate of Xi, positioning protrusion 68 is positioned between edges 83L and 83R, which limit movement of positioning protrusion 68 in the Y-axis direction. Thus, insertion groove 83 is an example of a first limiting member that, when the exposure unit is guided by the guide member into the space defined in the image-forming apparatus (image-forming apparatus 1), contacts the second protrusion (positioning protrusion 68) from left and right directions with respect to the direction of insertion of the exposure unit to limit movement of the second protrusion in the left and right directions. Also, insertion groove 83 is an example of an insertion groove formed in the supporting plate, the insertion groove having an opening that faces in the direction opposite to the direction of insertion and receiving the second protrusion of the exposure unit when the exposure unit is inserted into the space defined in the image-forming apparatus. When positioning protrusion 68 is further moved in the direction indicated by arrow "a" (in the X(−) direction) so that the X-axis coordinate of point 68P becomes equal to X0, movement of positioning protrusion 68 is limited not only in the Y-axis direction by edges 83L and 83R but also in the X(−) direction by edge 83*a*. In this state, however, movement of positioning protrusion 68 is not limited by insertion groove 83 with respect to rotation around an axis parallel to the X-axis (this rotation is referred to as rolling), rotation around an axis parallel to the Y-axis (this rotation is referred to as pitching), and rotation around an axis parallel to the Z-axis (this rotation is referred to as yawing).

When the X-axis coordinate of point 68P reaches X0 as a result of insertion of image exposure unit 5, first supporting pin 71, which is provided in a leading part of image exposure unit 5 with respect to the direction of insertion, comes to be placed on top of first upright portion 87A of first supporting piece 87, and second supporting pin 75, which is provided in a trailing part of image exposure unit 5 with respect to the direction of insertion, comes to be placed on top of second upright portion 97B of second supporting piece 97 and abuts a side edge of first upright portion 97A to prevent movement.

FIGS. 6A and 6B show first bracket 92 in detail. Of the pair of first brackets 92 provided on first plate member 81 of supporting plate 80, the one on the Y(−) side is shown in these drawings. It should be noted, however, that first bracket 92 on the Y(+) side is plane-symmetric to first bracket 92 on the Y(−) side with respect to a plane that is normal to the Y-axis direction. FIG. 6A is a diagram showing first bracket 92, where spring mount 86 supporting flat spring 88 is detached from first supporting piece 87. FIG. 6B is a diagram showing a side view of first bracket 92 as seen in the Y(−) direction, where spring mount 86 supporting flat spring 88 is attached to first supporting piece 87, and third upright portion 87C of first supporting piece 87 is not shown. Flat spring 88 is provided such that when first supporting pin 71 is moved over the top of second upright portion 87B of first supporting piece 87 to be placed on top of first upright portion 87A, flat spring 88 flexes upward (in the Z(+) direction) as shown by a long- and double-short dashed line in FIG. 6B, and presses first supporting pin 71 downward (in the Z(−) direction). Thus, first upright portion 87A serves as an example of a second limiting member that, in a state where the movement of the second protrusion is limited by the first limiting member, contacts the first protrusions from underneath to limit downward movement of the first protrusions. Also, flat spring 88 is an example of a first pressing member that presses the first protrusions from above when the first protrusions are in contact with the second limiting member. Owing to the effect of flat spring 88 in each of first brackets 92, rolling (rotation around an axis parallel to the X-axis) and yawing (rotation around an axis parallel to the Z-axis) of image exposure unit 5 are suppressed.

Spring mount 86 of first bracket 92 has a tongue member 86*p* at a position spaced apart from an elastic part of flat spring 88 in the Y-axis direction. Tongue member 86*p* is made of steel having a thickness greater than that of flat spring 88. Further, tongue member 86*p* extends generally in the direction opposite to the direction of insertion (or extends generally in the X(+) direction), and is bent obliquely in the downward direction (in the Z(−) direction). Tongue member 86*p* has end surface 86*a* at a free end, and a point on tongue member 86*p* that is positioned at the lowermost position (in the Z(−) direction) is included in end surface 86*a*. When image exposure unit 5 is stationary, an upward force (a force in the Z(+) direction) applied to first supporting pin 71 does not exceed a normal force imparted from supporting plate 80 to bottom portion 64. In such a state, end surface 86*a* of tongue member 86*p* is positioned a predetermined distance above first supporting pin 71 (in the Z(+) direction), and thus, first supporting pin 71, which is pressed downward (in the Z(−) direction) by flat spring 88, does not contact tongue member 86*p*. However, in a case where an external force is applied to image exposure unit 5, a force urging first supporting pin 71 upward (in the Z(+) direction) or a force urging first supporting pin 71 to move against the downward (Z(−) direction) pressing force exerted by flat spring 88 may exceed the downward pressing force exerted by flat spring 88, though only for an instant. If flat spring 88 flexes upward (in the Z(+) direction) excessively due to the upward force, the elastic limit of flat spring 88 may be exceeded and flat spring 88 may become no longer capable of exerting a downward (Z(−) direction) pressing force. However, in the illustrated exemplary embodiment, even if an upward (Z(+) direction) force applied to first supporting pin 71 exceeds a downward (Z(−) direction) pressing force of flat spring 88, first supporting pin 71, which is caused to move upward (in the Z(+) direction), will collide against end surface 86*a* of tongue member 86*p*, and thus, the upward movement of first supporting pin 71 is limited and flat spring 88 is prevented from flexing beyond its elastic limit. Thus, tongue member 86*p*, which is provided to main body 40 via first bracket 92 and supporting plate 80, is an example of a first stopper member that, when the first protrusions move a predetermined distance in the upward direction against the pressing by the first pressing member, contacts the first protrusions to prevent movement of the exposure unit in the upward direction.

Figure 7A:
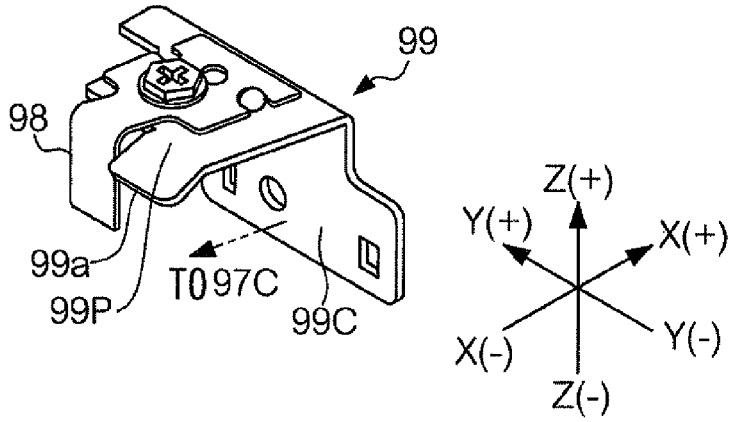
FIGS. 7A-7C show details of a second bracket.
Figure 7B:
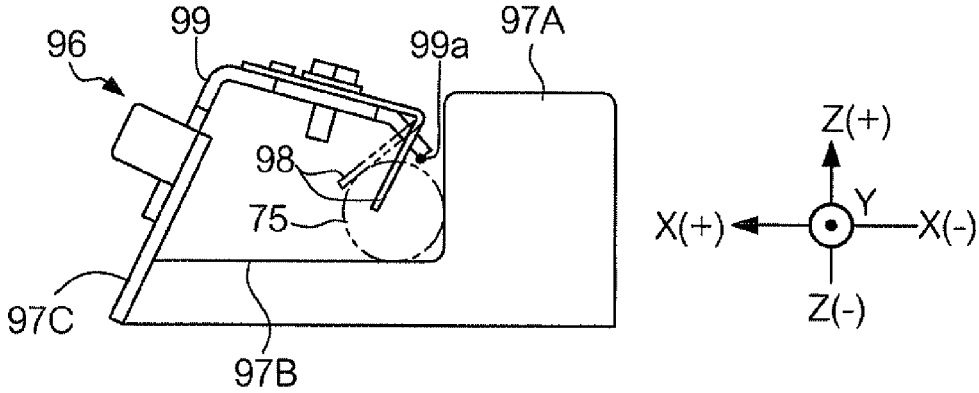
Figure 7C:
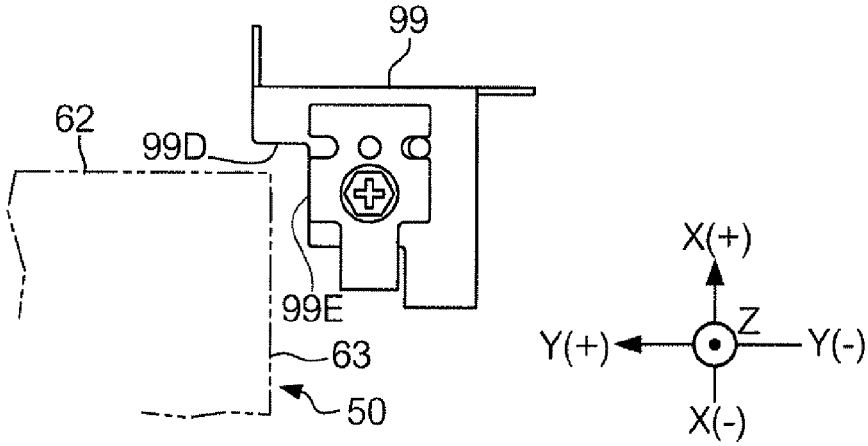

FIGS. 7A-7C show second bracket 96 in detail. Of the pair of second brackets 96 provided on second plate member 90 of supporting plate 80, the one on the Y(−) side is shown in these drawings. It should be noted, however, that second bracket 96 on the Y(+) side is plane-symmetric to second bracket 96 on the Y(−) side with respect to a plane that is normal to the Y-axis direction. FIG. 7A is a perspective view showing spring mount 99 of second bracket 96 and flat spring 98 attached to spring mount 99. Spring mount 99 has attachment surface 99C to be attached to the supporting surface of third upright portion 97C of second supporting piece 97 by means of a bolt or the like.

FIG. 7B is a side view of second bracket 96 as viewed in the Y(−) direction, where spring mount 99 is attached to second supporting piece 97. In an operation of inserting image exposure unit 5 into main body 40, second supporting pin 75 moves to be placed on top of second upright portion 97B and collides against a side edge part of first upright portion 97A to stop moving. Thus, second upright portion 97B of second supporting piece 97 is an example of a supporting member that supports the third protrusions from underneath. As described in the foregoing, in this state, flat spring 88 presses first supporting pin 71 downward (in the Z(−) direction). Thus, the side edge part of first upright portion 97A is an example of a third limiting member that, in a state where the first protrusions are pressed by the first pressing member, contacts the third protrusions in the direction opposite to the direction of insertion to limit movement of the third protrusions in the direction of insertion.

In an operation of attaching spring mount 98, on which flat spring 98 has been secured, to second supporting piece 97, flat spring 98 contacts second supporting pin 75, which is placed stationary on top of second upright portion 97B. As spring mount 99 is caused to contact more tightly against second supporting piece 97, flat spring 98 flexes to a greater extent in the upward direction (in the Z(+) direction) and in the direction opposite to the direction of insertion (in the X(+) direction), as shown by a long- and double-short dashed line in FIG. 7B, and accordingly presses second supporting pin 75 in the direction of insertion (in the X(−) direction) and in the downward direction (in the Z(−) direction). Thus, flat spring 98 is an example of a second pressing member that presses the third protrusions, whose movement in the direction of insertion is limited by the third limiting member, against the third limiting member and against the supporting member. In this way, pitching (rotation around an axis parallel to the Y-axis) of image exposure unit 5 is suppressed.

Spring mount 99 has tongue member 99*p* at a position spaced apart from an elastic part of flat spring 98 in the Y-axis direction. Tongue member 99*p* is made of steel having a thickness greater than that of flat spring 98. Further, tongue member 99*p* extends generally in the direction of insertion (or extends generally in the X(−) direction), and is bent obliquely in the downward direction (in the Z(−) direction). Tongue member 99*p* has end surface 99*a* at a free end, and a point on tongue member 99*p* that is positioned at the lowermost position (in the Z(−) direction) is included in end surface 99*a*. When image exposure unit 5 is stationary, an upward force (a force in the Z(+) direction) applied to second supporting pin 75 does not exceed a normal force imparted from supporting plate 80 to bottom portion 64. In such a state, end surface 99*a* of tongue member 99*p* is positioned a predetermined distance above second supporting pin 75 (in the Z(+) direction), and thus, second supporting pin 75, which is pressed downward (in the Z(−) direction) by flat spring 98, does not contact tongue member 99*p*. However, in a case where an external force is applied to image exposure unit 5, a force urging second supporting pin 75 upward (in the Z(+) direction) or a force urging second supporting pin 75 to move against the downward (Z(−) direction) pressing force exerted by flat spring 98 may exceed the downward pressing force exerted by flat spring 98, though only for an instant. If flat spring 98 flexes upward (in the Z(+) direction) excessively due to the upward force, the elastic limit of flat spring 98 may be exceeded and flat spring 98 may become no longer capable of exerting a downward (Z(−) direction) pressing force. However, in the illustrated exemplary embodiment, even if an upward (Z(+) direction) force applied to second supporting pin 75 exceeds a downward (Z(−) direction) pressing force of flat spring 98, second supporting pin 75, which is caused to move upward (in the Z(+) direction), will collide against end surface 99*a* of tongue member 99*p*, and thus, the upward movement of second supporting pin 75 is limited and flat spring 98 is prevented from flexing beyond the elastic limit. Thus, tongue member 99*p*, which is provided to main body 40 via second bracket 96 and supporting plate 80, is an example of a second stopper member that, when the third protrusions move a predetermined distance in a direction against the pressing by the second pressing member, contacts the third protrusions to prevent movement of the exposure unit against the pressing by the second pressing member.

FIG. 7C is a diagram showing spring mount 99 from above (or in the Z(−) direction). Trailing end portion 62 of box body 60 of image exposure unit 5 is placed to be a predetermined distance apart from surface 99D of spring mount 99 in the X(−) direction. When an external force is applied to image exposure unit 5, box body 60 may move in the forward/backward, right/left, and/or upward/downward directions, though only for an instant. In such a case, trailing end portion 62 of box body 60 collides against surface 99D of spring mount 99 to limit movement of image exposure unit 5 in the direction opposite to the direction of insertion (in the X(+) direction). Thus, trailing end portion 62 of box body 60 is an example of a trailing-end contact surface facing in the direction opposite to the direction of insertion, and surface 99D of spring mount 99 attached to main body 40 via supporting plate 80 is an example of a third stopper member that, when the exposure unit contained in the space defined in the image-forming apparatus moves a predetermined distance in the direction opposite to the direction of insertion, contacts the trailing-end contact surface of the exposure unit to prevent the movement of the exposure unit in the direction opposite to the direction of insertion.

Further, side portion 63 of box body 60 of image exposure unit 5 on the left side with respect to the direction of insertion of image exposure unit 5 (or on the Y(−) side) is placed a predetermined distance apart from surface 99E of Y(−)-side spring mount 99 in the right direction (in the Y(+) direction). When an external force is applied to image exposure unit 5, box body 60 may move in the forward/backward, right/left, and/or upward/downward directions, though only for an instant. In such a case, side portion 63 of box body 60 on the Y(−) side collides against surface 99E of Y(−)-side spring mount 99 to limit movement of image exposure unit 5 in the Y(−) direction. Thus, side portion 63 of box body 60 on the Y(−) side is an example of a left contact surface of the exposure unit facing in the left direction, and surface 99E of Y(−)-side spring mount 99 is an example of a left stopper member that, when the exposure unit contained in the space moves a predetermined distance in the left direction, contacts the left contact surface of the exposure unit to prevent the movement of the exposure unit in the left direction.

Similarly, side portion 63 of box body 60 of image exposure unit 5 on the right side with respect to the direction of insertion of image exposure unit 5 (or on the Y(+) side) collides against surface 99E of Y(+)-side spring mount 99 to limit movement of image exposure unit 5 in the Y(+) direction. Thus, side portion 63 of box body 60 on the Y(+) side is an example of a right contact surface of the exposure unit facing in the right direction, and surface 99E of Y(+)-side spring mount 99 is an example of a right stopper member that, when the exposure unit contained in the space moves a predetermined distance in the right direction, contacts the right contact surface of the exposure unit to prevent the movement of the exposure unit in the right direction. Owing to interactions between the trailing-end contact surface and the third stopper member, between the left contact surface and the left stopper member, and between the right contact surface and the right stopper member, it is prevented that the exposure unit held in the space defined by the frame moves to cause significant misalignment of the exposure unit.

As is described in the foregoing, image exposure unit 5 is properly positioned and held in a space defined between upper partition plate 45 and supporting plate 80 simply by insertion of image exposure unit 5 into the space and thereafter attachment of spring mount 99 to second supporting piece 97 secured on supporting plate 80.

Also, image exposure unit 5 and main body 40 of image-forming apparatus 1 are adapted such that holding of image exposure unit 5 in image-forming apparatus 1 is carried out in the following order: (1) positioning protrusion 68 is inserted into insertion groove 83; (2) first supporting pin 71 is held by first bracket 92; and (3) second supporting pin 75 is held by second bracket 96.

The reason step (1) is conducted prior to step (2) is explained below. When step (2) is conducted, first supporting pin 71 is pressed by flat spring 88 against first supporting piece 87 in the Z-axis direction, and this determines the position of leading end portion 61 of image exposure unit 5 in the X-axis and Z-axis directions. If step (1) has yet to be performed in this state, a user of image-forming apparatus 1 needs to align positioning protrusion 68 provided on leading end portion 61 of image exposure unit 5 with insertion groove 83, but leading end portion 61 has been inserted into the space within image-forming apparatus 1 and the only part that can be accessed by the user in this state is trailing end portion 62, which is near side cover 41. Further, because first supporting pin 71 on leading end portion 61 is held by first bracket 92, it is difficult for the user to move leading end portion 61 in the Y-axis direction to align positioning protrusion 68 with insertion groove 83. Therefore, if step (2) is conducted prior to step (1), alignment of leading end portion 61 in the Y-axis direction becomes difficult. For this reason, step (1) is conducted prior to step (2).

The reason step (2) is conducted prior to step (3) is similar to that described in the foregoing. That is, when image exposure unit 5 is contained in image-forming apparatus 1, the user can access only trailing end portion 62 near side cover 41, and therefore, after step (3) is conducted to determine the position of trailing end portion 62 in the Z-axis direction, it is difficult to conduct step (2) to determine the position of leading end portion 61 in the X-axis and Z-axis directions.

<2. Modified Embodiments>

The above-described exemplary embodiment may be modified as described in the following.

<2-1>

In the foregoing exemplary embodiment, first holding mechanism 85 and second holding mechanism 95 are constituted by first and second supporting pins 71, 75 provided to casing 50 of image exposure unit 5 and first and second brackets 92, 96 provided to supporting plate 80. However, the pins may be provided to supporting plate 80 and the brackets may be provided to casing 50. In this case also, it is preferred that pins that contact guides 89 for guiding insertion of image exposure unit 5 be provided to casing 50 of image exposure unit 5. This is because guides 89 are provided to maintain posture of image exposure unit 5 during insertion of image forming apparatus 5 into main body 40 to prevent image exposure unit 5 from pivoting around bending line 64B to cause leading end portion 61 to rise, for example, and thus, it is preferred that pins of which movement in the upward direction with respect to the direction of gravity is limited by guides 89 during the insertion be provided to image exposure unit 5 at a position spaced apart from the center of gravity of image exposure unit 5 in the direction of insertion.

Also, in the foregoing description of the exemplary embodiment, image-forming apparatus 1 having image exposure unit 5 installed therein is described. However, an image-forming apparatus may be provided in a state where an image exposure unit has yet to be installed.

The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments were chosen and described to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An exposure unit containment mechanism comprising:

an exposure unit that performs exposure in accordance with image data; and a frame that defines a space having an opening and containing the exposure unit inserted therein through the opening, wherein the exposure unit includes:

first protrusions provided at a position spaced apart from a center of gravity of the exposure unit in a direction of insertion of the exposure unit into the space, such that the first protrusions protrude left and right with respect to the direction of insertion;

a second protrusion that protrudes in a direction having a downward component; and third protrusions provided at a position spaced apart from the first protrusions and the second protrusion in a direction opposite to the direction of insertion, such that the third protrusions protrude in the left and right directions, and the frame includes:

a guide member that contacts the first protrusions from above to limit movement of the first protrusions in an upward direction and guide the insertion of the exposure unit;

a first limiting member that, when the exposure unit is guided by the guide member into the space, contacts the second protrusion from the left and from the right to limit left and right movement of the second protrusion;

a second limiting member that, in a state where the movement of the second protrusion is limited by the first limiting member, contacts the first protrusions from underneath to limit downward movement of the first protrusions;

a first pressing member that presses the first protrusions from above when the first protrusions are in contact with the second limiting member;

a supporting member that supports the third protrusions from underneath;

a third limiting member that, in a state where the first protrusions are pressed by the first pressing member, contacts the third protrusions in the direction opposite to the direction of insertion to limit movement of the third protrusions in the direction of insertion; and a second pressing member that presses the third protrusions, whose movement in the direction of insertion is limited by the third limiting member, against the third limiting member and against the supporting member.

2. The exposure unit containment mechanism according to claim 1, wherein the frame includes a supporting plate that supports the exposure unit from underneath when the exposure unit is contained in the space, and the first limiting member includes an insertion groove formed in the supporting plate, the insertion groove having an opening that faces in the direction opposite to the direction of insertion and receiving the second protrusion of the exposure unit when the exposure unit is inserted into the space.

3. The exposure unit containment mechanism according to claim 1, wherein the frame includes a first stopper member that, when the first protrusions move a predetermined distance in the upward direction against the pressing by the first pressing member, contacts the first protrusions to prevent upward movement of the exposure unit.

4. The exposure unit containment mechanism according to claim 1, wherein the frame includes a second stopper member that, when the third protrusions move a predetermined distance in a direction against the pressing by the second pressing member, contacts the third protrusions to prevent movement of the exposure unit against the pressing by the second pressing member.

5. The exposure unit containment mechanism according to claim 1, wherein the exposure unit has a trailing-end contact surface facing in the direction opposite to the direction of insertion, and the frame includes a third stopper member that, when the exposure unit contained in the space moves a predetermined distance in the direction opposite to the direction of insertion, contacts the trailing-end contact surface of the exposure unit to prevent the movement of the exposure unit in the direction opposite to the direction of insertion.

6. The exposure unit containment mechanism according to claim 1, wherein the exposure unit includes:

a left contact surface facing in the left direction; and a right contact surface facing in the right direction, and the frame includes:

a left stopper member that, when the exposure unit contained in the space moves a predetermined distance in the left direction, contacts the left contact surface of the exposure unit to prevent the movement of the exposure unit in the left direction; and a right stopper member that, when the exposure unit contained in the space moves a predetermined distance in the right direction, contacts the right contact surface of the exposure unit to prevent the movement of the exposure unit in the right direction.

7. An image-forming apparatus comprising:

the exposure unit containment mechanism according to claim 1: and an image-forming device that develops a latent image in accordance with exposure performed by the exposure unit contained in the space defined by the frame of the exposure unit containment mechanism, transfers the developed image onto a medium, and fixes the transferred image.

8. An exposure unit containment mechanism comprising:

a frame that defines a space having an opening through which an exposure unit is inserted, wherein the frame includes:

a guide member that contacts first protrusions of the exposure unit from above to limit movement of the first protrusions in an upward direction and guide the insertion of the exposure unit, the first protrusions being provided at a position spaced apart from a center of gravity of the exposure unit in a direction of insertion of the exposure unit into the space, such that the first protrusions protrude left and right with respect to the direction of insertion;

a first limiting member that, when the exposure unit is guided by the guide member into the space, contacts a second protrusion of the exposure unit from the left and from the right to limit left and right movement of the second protrusion, the second protrusion protruding in a direction having a downward component;

a second limiting member that, in a state where the movement of the second protrusion is limited by the first limiting member, contacts the first protrusions from underneath to limit downward movement of the first protrusions;

a first pressing member that presses the first protrusions from above when the first protrusions are in contact with the second limiting member;

a supporting member that supports third protrusions of the exposure unit from underneath, the third protrusions being provided at a position spaced apart from the first protrusions and the second protrusion in a direction opposite to the direction of insertion, such that the third protrusions protrude in the left and right directions;

a third limiting member that, in a state where the first protrusions are pressed by the first pressing member, contacts the third protrusions in the direction opposite to the direction of insertion to limit movement of the third protrusions in the direction of insertion; and a second pressing member that presses the third protrusions, whose movement in the direction of insertion is limited by the third limiting member, against the third limiting member and against the supporting member.

* * * * *